United States Patent [19]

Rusteikas

[11] 4,140,277

[45] Feb. 20, 1979

[54] PORTABLE COKE QUENCHING APPARATUS

[75] Inventor: Leo F. Rusteikas, Duquesne, Pa.

[73] Assignee: United States Steel Corporation, Pittsburgh, Pa.

[21] Appl. No.: 828,077

[22] Filed: Aug. 26, 1977

[51] Int. Cl.[2] ..... B05B 3/18

[52] U.S. Cl. ..... 239/186; 239/286

[58] Field of Search ..... 239/186, 178, 163, 286; 254/86

[56] References Cited

U.S. PATENT DOCUMENTS

| | | | |
|---|---|---|---|
| 1,007,439 | 10/1911 | Flaccus | 239/186 |
| 1,088,236 | 2/1914 | Lutenberger | 254/86 R |
| 2,748,875 | 6/1956 | Trinity et al. | 239/286 |

*Primary Examiner*—James B. Marbert

*Attorney, Agent, or Firm*—Walter P. Wood

[57] ABSTRACT

A portable coke quenching apparatus for use when the regular quench tower at a coke oven battery is out of service. The apparatus includes two properly designed trailers positioned end-to-end and piping carried by the trailers to project over a quench car and spray water on coke carried by the car, and thus quench the coke in a similar manner to the regular quench tower.

7 Claims, 3 Drawing Figures

PORTABLE COKE QUENCHING APPARATUS

This invention relates to a portable apparatus for quenching coke.

When hot coke is pushed from a coke oven, it is received in a quench car which runs along a track at the coke side of the battery of ovens. Normally the car transports the coke to a fixed quench tower where water is sprayed on the coke to cool it. Sometimes the quench tower is out of service while maintenance or repair work is in progress, and as a result the coke handling operation is seriously hampered. When the quench tower is unavailable, conventional practice has been for workmen, standing on the battery, to quench the coke manually using fire hoses. It takes about 20 minutes to quench a carload of coke by this procedure, contrasted with only a little more than one minute in the regular quench tower. Quenching with fire hoses not only is unduly slow, but is a disagreeable task for workmen.

An object of the present invention is to provide a portable apparatus which can be used for quenching coke efficiently whenever the regular quench tower is out of service.

A further object is to provide a portable quenching apparatus which overcomes need for manually spraying water to quench coke in the event the regular tower is out of service.

Figure 1:
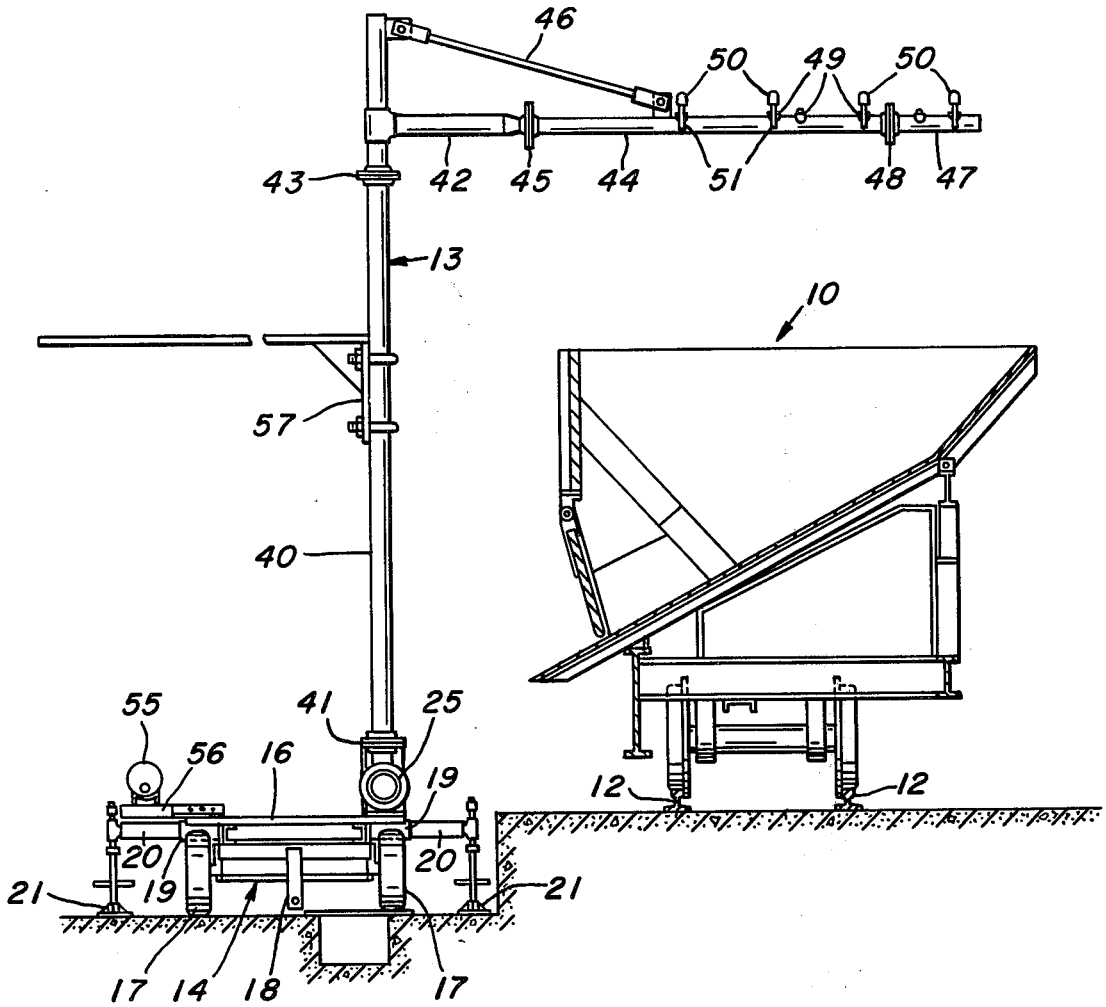
FIG. 1 is an end elevational view of a conventional quench car and a quenching apparatus constructed in accordance with the invention.

The drawings show a conventional quench car 10 which runs on rails 12 parallel with the coke side of a battery of coke ovens (not shown). Normally the car carries coke from each oven in turn to a fixed quench tower (not shown), where water is sprayed on the coke to cool it. The drawings also show a portable quenching apparatus 13 constructed in accordance with the present invention for use when the quench tower is out of service. The apparatus is positioned alongside the car 10 at the side opposite the battery.

The portable quenching apparatus includes two trailers 14 and 15 positioned end-to-end or equivalent transport means. The trailers are separately movable and have respective decks 16, wheels 17 and tongues 18 to enable them to be towed or pushed to locations where needed. The undersides of the decks 16 carry transverse channels 19 near each end in which box-beams 20 are mounted for slidable movement transversely of the trailers. After the trailers are moved to a location where the apparatus is to be used, the box beams are extended to overhang both side edges of the trailers and respective jacks 21 are inserted in the box beams, four jacks per trailer. The jacks are used to lift the trailers and thus support them in a stable level position.

Figure 3:
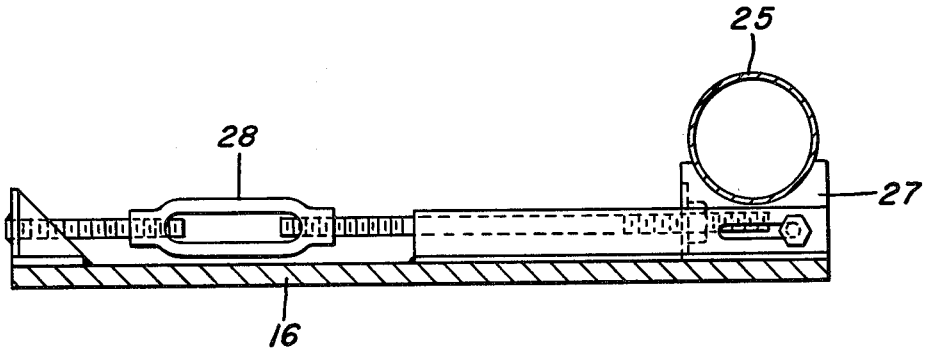
FIG. 3 is a vertical section on line III—III of FIG. 2.
Figure 2:
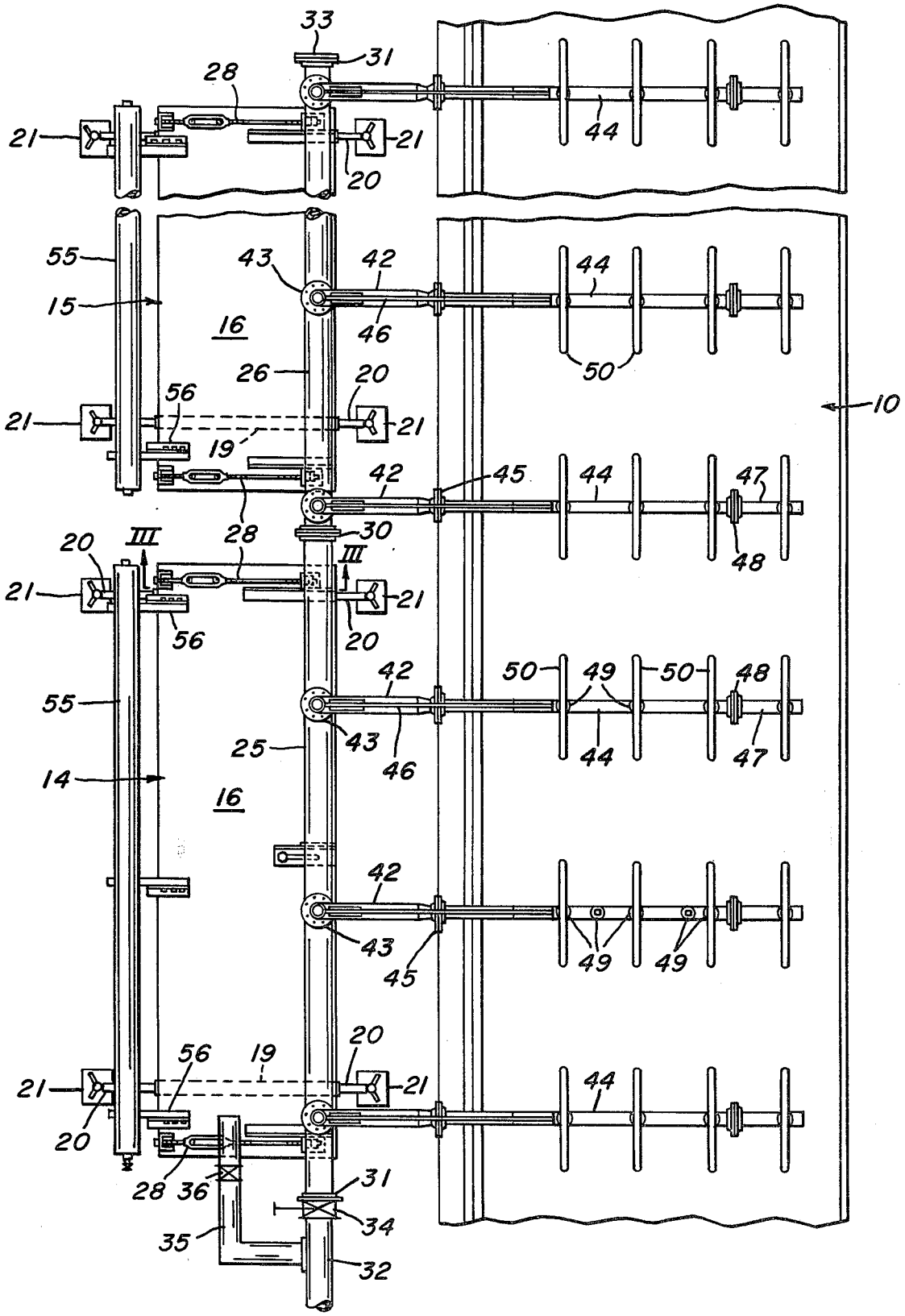
FIG. 2 is a top plan view of the car and quenching apparatus.

The trailers 14 and 15 carry respective relatively large diameter header sections 25 and 26 which extend lengthwise at the side nearer the quench car 10. The header sections are supported on brackets 27 which are mounted near the opposite ends of the trailers for limited movement transversely of the trailers. Turnbuckles 28 are connected to the brackets for adjusting the position of the header sections (FIG. 3). The confronting ends of the header sections have flanges 30 which are bolted together, whereby the two sections form a single continuous header extending the length of the apparatus. The other end of each header section has a respective flange 31 to which either a water supply line 32 or a closure 33 can be attached. Thus water can be supplied to the header from either end. FIG. 2 shows the water supplied to the header section 25 on trailer 14. Conveniently the supply line 32 is a pipe of the same diameter as the header (for example 10 inches) run above ground from the quench tower which is out of service. The water supply line is shown equipped with a manually operated valve 34, but this may be replaced with automatic means for starting and stopping flow of water to the header. FIG. 2 shows also a supplementary connection 35 and valve 36 through which additional water can be supplied from a hose if needed.

A plurality of riser pipes 40 are removably connected to the header 14, 15 through respective flanges 41. Respective elbows or tees 42 are removably connected to the upper ends of the riser pipes through flanges 43. Respective transversely extending horizontal pipes 44 are removably connected to the elbows or tees with flanges 45. Diagonal braces 46 assist in supporting the horizontal pipes. The horizontal pipes 44 may have extensions 47 removably connected through flanges 48. The horizontal pipes 44 and extensions 47 have a plurality of fittings 49 to which outlet pipes 50 can be removably connected or which can be plugged selectively to suit the style of quench car in use. The outlet pipes 50 have downwardly directed spray nozzles 51.

The parts are proportioned so that the horizontal pipes 44 and outlet pipes 50 project over a quench car 10 spaced about five or six feet thereabove. The outlet pipes 50 are connected to selected fittings 49 to provide uniformly spaced sprays across the width of the car and avoid both unquenched spots in the coke or excessively wet spots. The other fittings 49 are plugged. In the arrangement shown in FIG. 2, each horizontal pipe 44 has an extension 47, and the pipe and its extension carry four outlet pipes 50, but this may vary for differently proportioned quench cars. Final adjustment of the position of the sprays can be made by adjusting the turnbuckles 28.

Each trailer 14 and 15 carries a respective counterbalance pipe 55 which is filled with water. The counterbalance pipes are supported on bars 56. Preferably the riser pipes 40 carry brackets 57 for supporting a platform or scaffold used by workmen in assembling or dismantling the apparatus.

In operation, when the apparatus 13 is needed for quenching, the two trailers 14 and 15 are pushed or towed to a location adjacent the rails 12. Normally the various pipes are disconnected at the flanges when the trailers are moved, since the pipes would be in the way of moving. When the trailers are at the proper location, the jacks 21 are inserted and operated to lift the trailers and support them in a stable level position. The two header sections 25 and 26 are connected at the flanges 30, and the other pipes installed in the proper relation. One end of the header 25, 26 is connected to the water supply line 32. As each car of coke is positioned under the spray nozzles 51, valve 34 is opened to quench the coke in a manner similar to the normal quench tower. The preferred practice is to spray water on each carload for about a minute and a half to quench the coke properly.

From the foregoing description it is seen that the present invention affords a simple apparatus which enables coke to be quenched in almost the normal manner at times when the regular quench tower is out of service. The apparatus is portable and can be moved readily to any location where needed. Only about one day's (8 hours) time is needed to move the apparatus to its position for quenching and set it up.

I claim:

1. A portable apparatus for quenching coke, said apparatus comprising two trailers positioned end-to-end, respective header sections supported on said trailers and extending lengthwise near one edge thereof, means connecting said sections to form a continuous header, a plurality of riser pipes extending upwardly from said header to a height above a quench car, respective horizontal pipes carried by said riser pipes, and means carried by said horizontal pipes for spraying water introduced to said header on a quench car positioned alongside said trailers and beneath said horizontal pipes.

2. An apparatus as defined in claim 1 further comprising jacks connected with said trailers at both sides and near both ends for lifting the trailers and supporting them in a stable level position.

3. An apparatus as defined in claim 2 further comprising box beams carried by said trailers for movement transversely thereof, said jacks being inserted in said box beams.

4. An apparatus as defined in claim 1 in which said riser pipes have flange connections with said header, and said horizontal pipes have flange connections with said riser pipes enabling the riser pipes and horizontal pipes to be removed to facilitate moving said trailers and facilitate quenching of hot coke irrespective of size of quench car in use.

5. An apparatus as defined in claim 1 further comprising counterbalance means carried by said trailers near the edge opposite said header sections.

6. An apparatus as defined in claim 5 in which said header sections are adjustable transversely of said trailers.

7. A portable apparatus for quenching coke, said apparatus comprising:

two trailers positioned end-to-end and having respective decks and wheels;

beams supported for transverse movement on the underside of said decks at each side thereof and near each end;

respective jacks connected to said beams outwardly of said decks for lifting said trailers and supporting them in stable level positions;

respective header sections supported on said decks and extending lengthwise near one side edge thereof;

flange means connecting said sections to form a continuous header extending the length of the two trailers;

a plurality of riser pipes having removable flange connections with said header and extending upwardly therefrom to a height above a quench car;

respective horizontal pipes having removable flange connections with said riser pipes and extending outwardly from said decks;

means carried by said horizontal pipes for spraying water introduced to said header on a quench car positioned alongside said trailers and beneath said horizontal pipes; and counterbalance means supported on said decks near the side edges opposite said header sections.

* * * * *